US006718567B2

(12) United States Patent
Gibson et al.

(10) Patent No.: US 6,718,567 B2
(45) Date of Patent: Apr. 13, 2004

(54) SWIMMING POOL WATER LEVEL CONTROLLER

(75) Inventors: J. Clifton Gibson, Watauga, TX (US); J. James Seivert, Garland, TX (US)

(73) Assignee: Sons Design & Manufacturing, Inc., Dallas, TX (US)

( * ) Notice: Subject to any disclaimer, the term of this patent is extended or adjusted under 35 U.S.C. 154(b) by 0 days.

(21) Appl. No.: 10/157,477

(22) Filed: May 29, 2002

(65) Prior Publication Data

US 2003/0221250 A1 Dec. 4, 2003

(51) Int. Cl.[7] ..... E04H 4/00

(52) U.S. Cl. ..... 4/508; 4/507; 73/304 C; 340/573.6

(58) Field of Search ..... 4/507, 496, 504, 4/508; 340/620, 526, 529, 530, 573.6; 73/304 R, 304 C

(56) References Cited

U.S. PATENT DOCUMENTS

| | | | | | |
|---|---|---|---|---|---|
| 2,809,752 | A | * | 10/1957 | Leslie | 210/127 |
| 3,837,015 | A | * | 9/1974 | Whitaker | 4/508 |
| 3,895,402 | A | * | 7/1975 | Page | 4/508 |
| 4,133,058 | A | * | 1/1979 | Baker | 4/494 |
| 4,227,266 | A | * | 10/1980 | Russell | 4/496 |
| 4,265,598 | A | * | 5/1981 | Brand | 417/40 |
| 4,297,686 | A | * | 10/1981 | Tom | 340/604 |
| 4,380,091 | A | * | 4/1983 | Lively | 4/508 |
| 4,445,238 | A | * | 5/1984 | Maxhimer | 4/508 |
| 4,592,098 | A | * | 6/1986 | Magnes | 4/508 |
| 4,612,949 | A | * | 9/1986 | Henson | 137/2 |
| 4,739,786 | A | * | 4/1988 | Parkinson | 137/2 |
| 4,817,217 | A | * | 4/1989 | Lively | 4/508 |
| 5,730,861 | A | * | 3/1998 | Sterghos et al. | 210/86 |
| 5,804,080 | A | * | 9/1998 | Klingenberger | 210/739 |
| 5,878,447 | A | * | 3/1999 | Mogab et al. | 4/508 |
| 6,006,605 | A | * | 12/1999 | Sulollari | 73/306 |
| 6,052,841 | A | * | 4/2000 | Mankin et al. | 4/427 |
| 6,276,200 | B1 | * | 8/2001 | Cazden | 73/305 |
| 6,568,264 | B2 | * | 5/2003 | Heger | 73/304 |

* cited by examiner

*Primary Examiner*—Henry Bennett
*Assistant Examiner*—Amanda Flynn
(74) *Attorney, Agent, or Firm*—Bracewell & Patterson, LLP

(57) ABSTRACT

A water level controller for a pool has a water level sensor immersed in the pool. A processor detects if the sensor senses low water. A transmitter sends a radio frequency signal to a receiver if the processor detects the low water. The receiver turns on a valve to add water to the pool. The transmitter and processor are contained in a waterproof housing. A main power switch is located internally in the housing, and moves between on and off positions by inverting the housing. A wave filter timer within the processor turns on for a selected interval when the processor detects low water. The receiver has an overfill counter that turns on for a selected interval when the receiver receives the low water signal. The receiver resets the overfill counter prior to reaching the selected count each time that the receiver receives a low water signal.

31 Claims, 5 Drawing Sheets

30
48
61
Sensor
Processor
Wave filter Timer
50
Transmitter

Up end Unit
52
Start Processor
54
Turn on Probe
56
58
Probe in Water
Y
64
Reset Wave Filter Timer
N
60
Start Wave Filter Timer
62
Turn on Transmitter 22
91
Receiver
Overfill Timer
23
Valve 92
94
Signal Received
N
Close Valve
96
Y
Start Overfill Timer
98
100
Time > X min
N
Open Valve
102
Y
Close Valve

SWIMMING POOL WATER LEVEL CONTROLLER

FIELD OF THE INVENTION

This invention relates in general to automatic water leveling systems, and in particular to a device for monitoring a swimming pool water level and supplying additional water when needed.

BACKGROUND OF THE INVENTION

Conventional swimming pools and hot tubs include systems for recirculating the water in the pool or tub. As the pool water is recirculated, it is typically filtered and cleaned and may also be heated, if desired. Some pools have an automatic float level system. However, the majority of home pools do not have such a system for adding water to make up lost water due to evaporation and other causes. The home owner simply uses a garden hose from time to time to add water. This is time consuming and inconvenient.

Pools that have an automatic water level system often rely upon one or more float valves that are associated directly with the inlets and outlets for water entering and leaving the pool. When the water level in the pool rises or falls, the floats mechanically actuate valves to cause water to enter or leave the pool. Examples of these mechanical types of systems are shown in U.S. Pat. Nos. 2,809,752, 3,837,015, and 3,895,402. Unfortunately, because the floats and valves of these systems are quite visible and located in or near the pool, they are vulnerable to damage or vandalism from swimmers. The floats can be broken or rendered inoperable, thus negating the effectiveness of the system.

Systems are known that incorporate an overflow tank or sump that is separate from the pool. The level of the water in the separate tank is used as an indicator of the level of water in the swimming pool. This separate tank is then monitored using a sensor, float, or other device. Examples of these types of systems are shown in U.S. Pat. Nos. 5,804,080, 4,445,238 and 3,895,402. These systems have the advantage of allowing the components necessary to measure the liquid level in the pool to be located away from the main pool. However, because a separate tank is required to be associated with the pool, these systems must be installed when the pool is originally constructed. Otherwise, a retrofitting must be done wherein portions of the concrete surrounding the pool are broken up to install the separate tank and associated components. This can be costly and time-consuming and requires that the pool be closed down during installation.

U.S. Pat. No. 5,878,447 shows a sensor for sensing the water level and sending a radio frequency transmission to a receiver. The receiver is electrically connected to a solenoid valve of a water source. While such a system is workable, improvements are desirable.

SUMMARY OF THE INVENTION

The fluid leveler of this invention has a sensor that is immersed in the pool. A processor electrically connected with the sensor detects low water in the pool. A transmitter connected with the processor sends a radio frequency signal if the processor detects the low water. A waterproof housing contains the processor and transmitter circuitry and a battery for powering the processor and transmitter. A remote receiver receives the signal from the transmitter and turns on a valve to add water to the pool.

In the preferred embodiment, a tilt switch is connected between the battery and the processor for supplying power to the processor while in an on position. The tilt switch is enclosed within the housing and movable between the on and off position by tilting the housing. The tilt switch is in an off position when the housing is inverted from an operational position.

The processor preferably has a wave filter timer that turns on for a selected interval when the processor detects low water and delays the transmitter from sending the signal until the end of the selected interval. The processor causes the transmitter to send the signal at the end of the selected interval only if the processor continuously detects low water during the selected interval.

Preferably a power input of the transmitter is connected to an output of the processor so that the transmitter is supplied with power only when the processor directs the transmitter to send the signal. This reduces battery consumption. A low battery voltage detector is connected to the processor for informing the processor if low battery voltage is detected. The processor encodes a low battery voltage indication into the signal being sent by transmitter that indicates low water.

The receiver has an overfill counter that turns on for a selected interval when the receiver receives one of the signals from the transmitter. The overfill counter causes the valve to remain on until the overfill counter reaches a selected count. However, the receiver resets the overfill counter each time that the receiver receives one of the signals from the transmitter. This assures that a selected amount of overfill will occur.

DETAILED DESCRIPTION OF THE INVENTION

Figure 1:
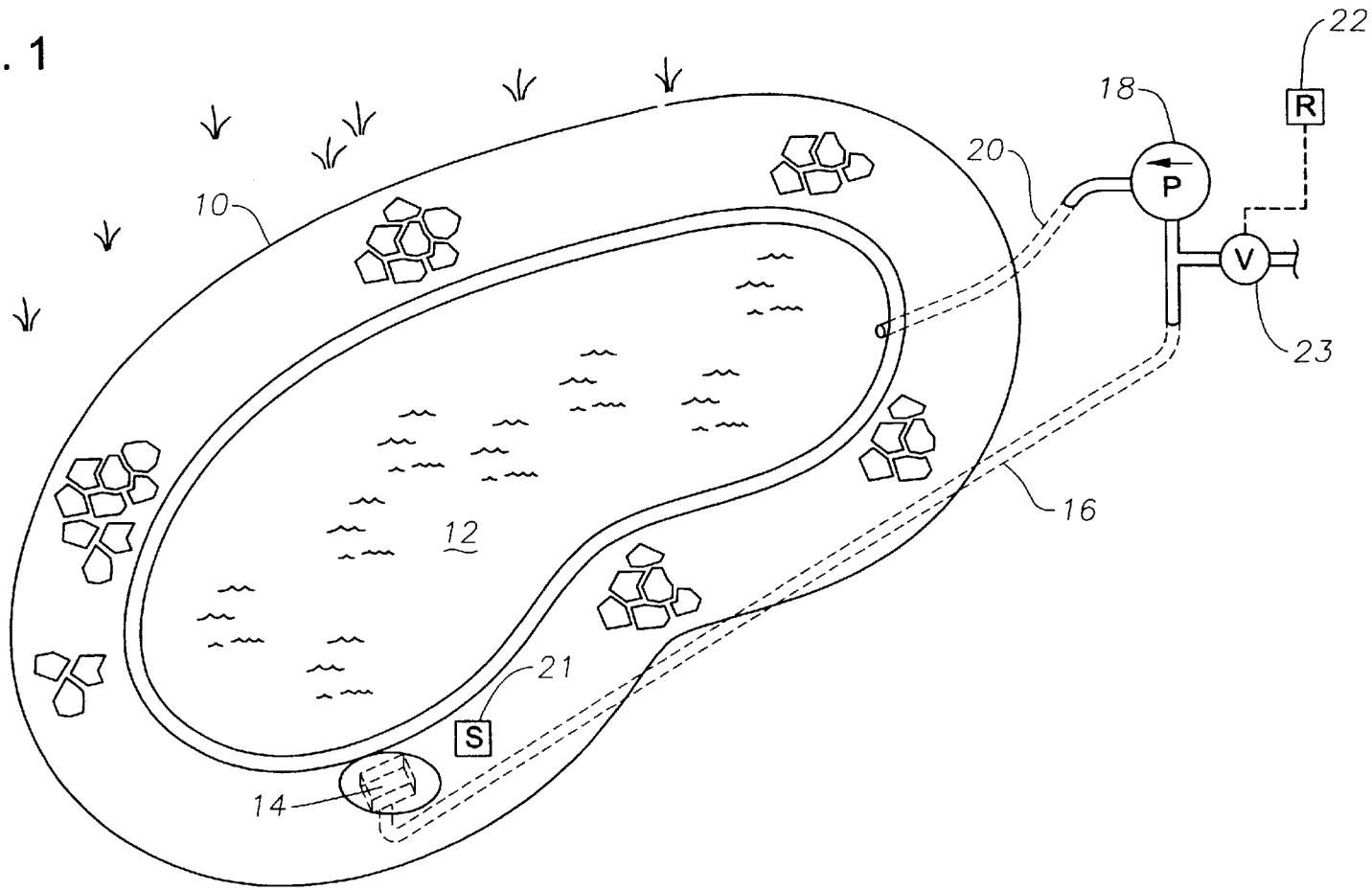
FIG. 1 is a schematic view illustrating a swimming pool recirculation system with a water leveler in accordance with this invention.

Referring to FIG. 1, a pool 10 is shown which contains an amount of water 12. Pool 10 may be a swimming pool or some other type of pool that has a recirculation system. Pool 10 has a number of skimmers or outlets 14 (only one shown) for recirculating water. A water outflow line 16 extends downward from skimmer 14 and extends to an intake of a circulation pump 18. A water inflow line 20 extends from an output of circulation pump 18 back to pool 10. Both inflow and outflow lines 20, 16 are typically located below ground.

In some instances, however, they are above ground. In general operation, circulation pump 18 continuously draws water 12 from pool 10 through outflow line 16 and pumps it through inflow line 20 back into pool 10. There are one or more filters or other cleaners and perhaps a heater associated with this circulation system.

This system also has automatic filling equipment to replace water lost due to evaporation and other reasons. This system includes a sensor assembly 21, which may be located in one of the skimmers 14 or elsewhere. Sensor assembly 21 senses the level of water 12, and if it is below a selected level, sends a radio frequency signal to a receiver 22. Receiver 22 is located in the vicinity of circulation pump 18 and is connected to a solenoid valve 23. Valve 23 is located in a supply line, which is connected to a source of water, such as the city water supply. Valve 23 is preferably connected to the suction side of pump 18, but it could also be connected to an inflow line separate from inflow line 20 of pump 18. Upon receiving an RF signal from sensor 21, receiver 22 opens valve 23 to allow water to flow from the city supply into inflow line 20. When the water reaches an adequate level, receiver 22 cuts off valve 23.

Figure 2:
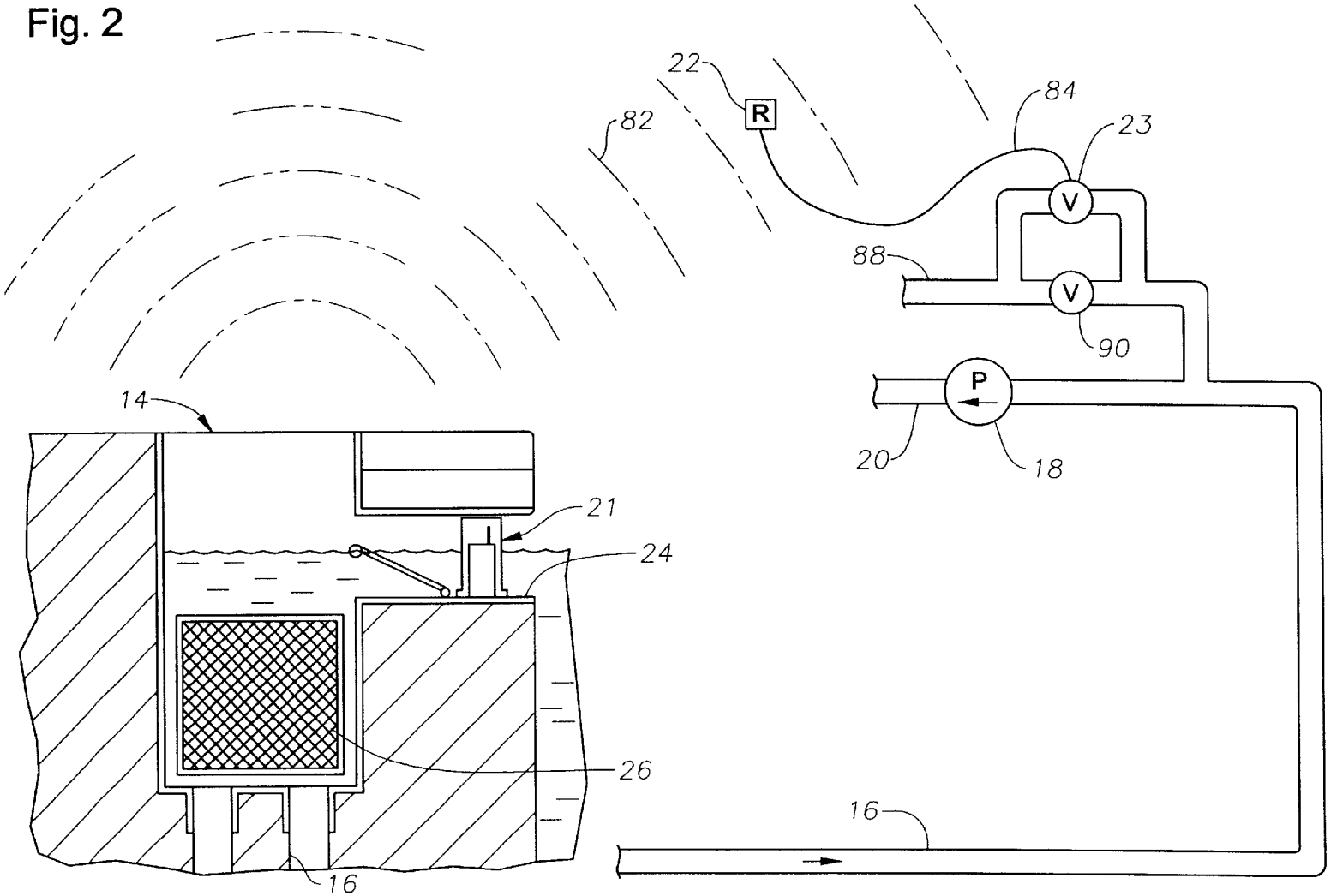
FIG. 2 is an enlarged schematic view of portions of the water leveler of FIG. 1.
Figure 3:
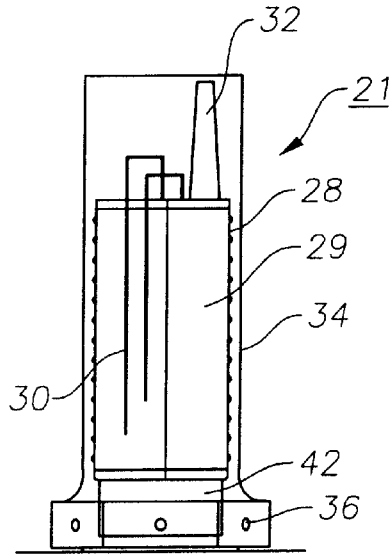
FIG. 3 is a side elevational view of the transmitter and sensor of the water leveler of FIG. 2, with the cap of the housing shown removed.
Figure 4:
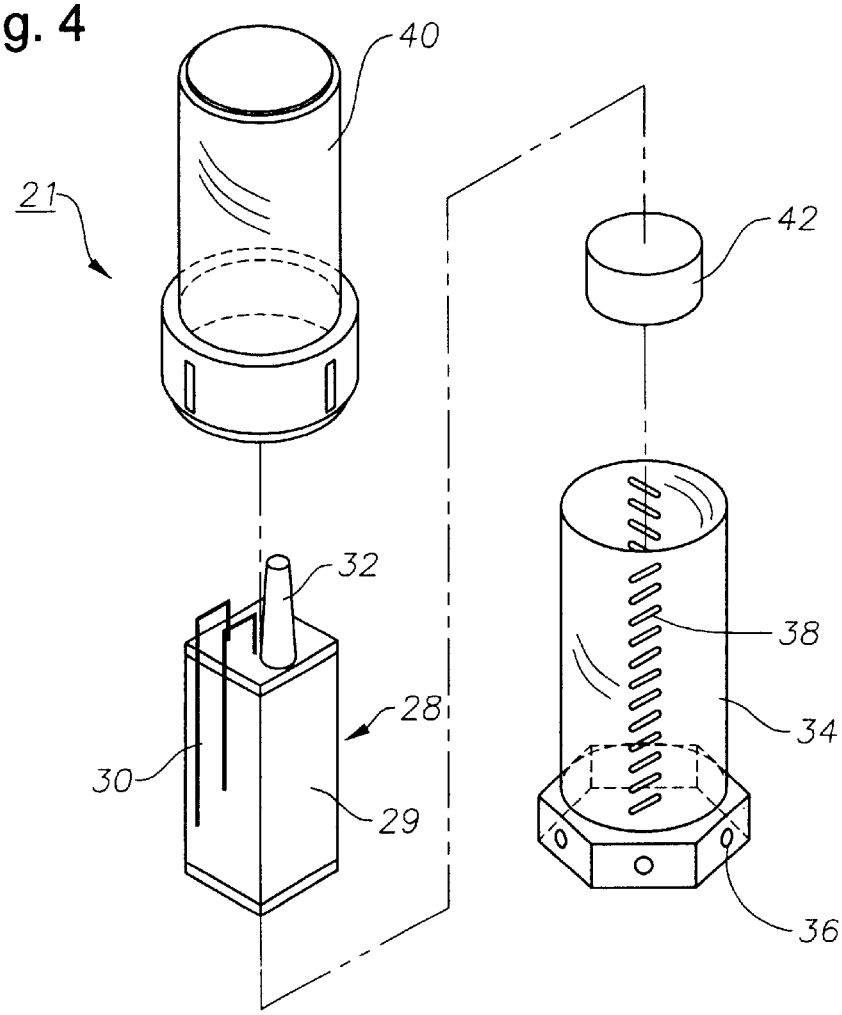
FIG. 4 is an exploded view of the transmitter and sensor of FIG. 3.

Referring to FIG. 2, skimmer 14 has a throat 24 for receiving water from pool 10. Throat 24 includes a port in the sidewall of the pool. A basket 26 is located within skimmer 14 for filtering debris in the water as it is drawn through throat 24 and into flow line 16. In the preferred embodiment, sensor assembly 21 is mounted in throat 24, however it could be mounted elsewhere. Referring to FIGS. 3 and 4, sensor assembly 21 includes a sensor and transmitter 28 assembly, which is a single integral unit and is to be referred to hereafter as sensor 28. Sensor 28 includes an elongated housing 29 that is rectangular in configuration, although this could be varied. A pair of wires or probes 30 extend outward from housing 29 and alongside one of the sidewalls. One of the probes 30 is longer than the other, and probes 30 are connected to electrical circuitry inside sensor 28. Water 12 is conductive, thus the circuitry will sense when both probes 30 are immersed in water. The circuitry detects the loss in conductivity that occurs when one probe 30 is spaced above the water. Sensor 28 also has an antenna 32 for transmitting an RF signal.

Sensor 28 locates within a container base 34 in this embodiment. Container base 34 is a cylindrical tube that has a bottom with a plurality of holes 36 to allow water to flow into container base 34. Container base 34 has a plurality of thread segments 38 along its sidewall. A spacer 42 may be employed to extend the height of sensor 28, if needed. A container cap 40 (not shown in FIG. 3) fits over the sidewall of container base 34. Container cap 40 has internal threads that engage thread segments 38. Rotating container cap 40 in one direction relative to base 34 will unscrew it from threads segments 38 and extend the overall distance between the top of cap 40 and the bottom of container base 34. Container base 34 and container cap 40 thus telescope in length to allow sensor assembly 21 to be releasably wedged between upper and lower sides of throat 24 (FIG. 2). The user places sensor assembly 21 in throat 24 while container base 34 and container cap 40 are in a reduced length position, then rotates one relative to the other to increase the length until sensor assembly 21 is frictionally held in throat 24.

Figure 5:
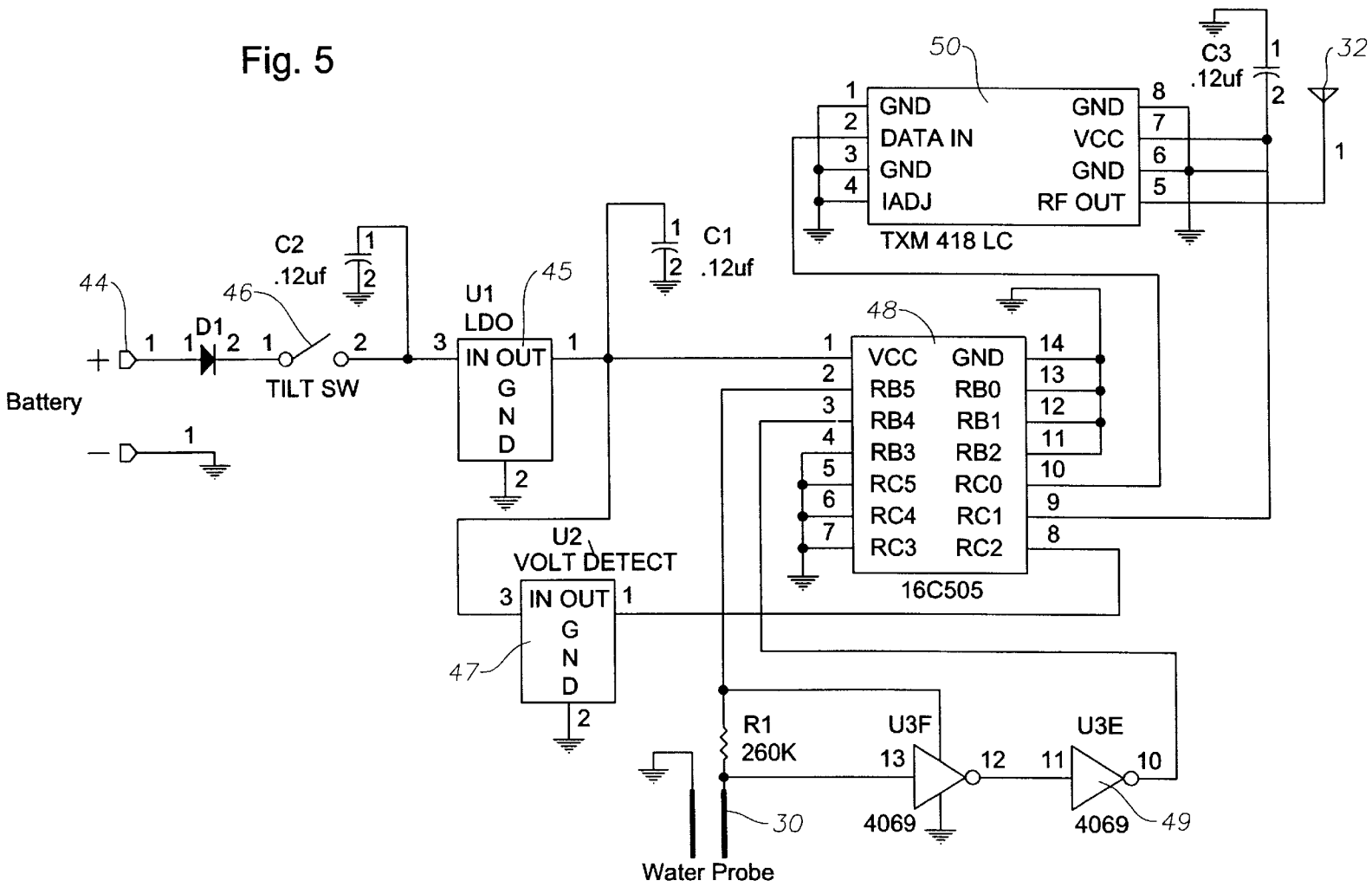
FIG. 5 is an electrical schematic view of the sensor and transmitter of FIG. 3.

FIG. 5 illustrates the components located and sealed within housing 29 (FIG. 4), which is waterproof. The components include a battery 44 and an internal switch 46. To reduce the chance for leakage, switch 46 is not exposed to nor accessible from the exterior of housing 29. Switch 46 is a tilt type known as a mercury switch, that turns on and off by tilting. When sensor 28 is in the upright position shown in FIG. 3, switch 46 will be closed. When sensor 28 is inverted or even partially inverted, switch 46 will open. This allows sensor 28 to be reset simply by inverting sensor 28 then returning it to the upright position. Sensor 28 may also be left in an off position by placing it in an inverted position. During the winter if the recirculation system is not being used, housing 29 is preferably left in an inverted position to avoid consumption of battery 44. It is not necessary to remove sensor 28 from container base 34 and cap 40 to actuate tilt switch 46.

Referring to FIG. 5, sensor 28 also contains a conventional integrated processor circuit 48 that has a number of functions. Processor 48 has an intermittent duty cycle and a sleep cycle. In the sleep cycle, processor 48 consumes much less power than when in the duty cycle. In one embodiment, processor 48 has a duty cycle every 18 milliseconds. The duration of the duty cycle is in micro seconds, thus processor 48 will be in the sleep cycle much more so than the duty cycle. By way of example, voltage is applied to probes 30 for only about 15 micro seconds during the duty cycle.

A conventional voltage regulator 45 is connected between battery 44 and processor 48. A conventional voltage detector circuit 47 is connected also to processor 48 and the output of voltage regulator 45 for sensing the level of the voltage. Voltage detector 47 supplies a corresponding signal to processor 48. Voltage detector 47 receives its power from voltage regulator 45, thus is turned on to sample the voltage only during the duty cycle.

Processor 48 is connected to one of the probes 30, the other being grounded. Amplifiers 49 are connected to the probe 30 that leads to processor 48 for amplifying voltage differential between probes 30. If there is no continuity between probes 30, processor 48 provides a signal to a transmitter 50. Transmitter circuit 50 is a conventional integrated circuit that provides a digital signal to antenna 32. When instructed by processor 48, transmitter 50 provides a single digitally encoded RF signal of a selected duration, then it is turned off by processor 48. Transmitter circuit 50 also has its power input connected to a power output from processor 48. Consequently, it is turned on only when processor 48 causes transmitter 50 to send an RF signal. Processor 48 also encodes into the RF digital signal a portion that indicates that the battery level is low if such is indicated by voltage detector 47. Processor 48 will not cause transmitter 50 to send a low voltage signal until it receives a low water indication from probes 30. The low voltage signal, when it occurs, is always encoded as part of the low water signal being sent from transmitter 50.

Figure 6:
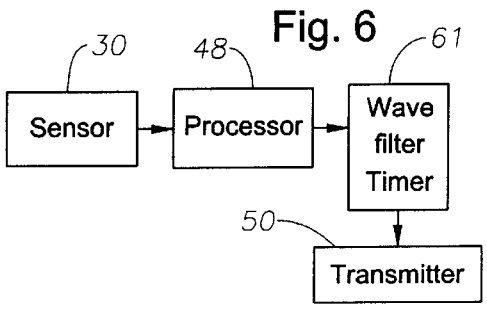
FIG. 6 is a block diagram of the major components of the sensor and transmitter of FIG. 3.
Figure 7:
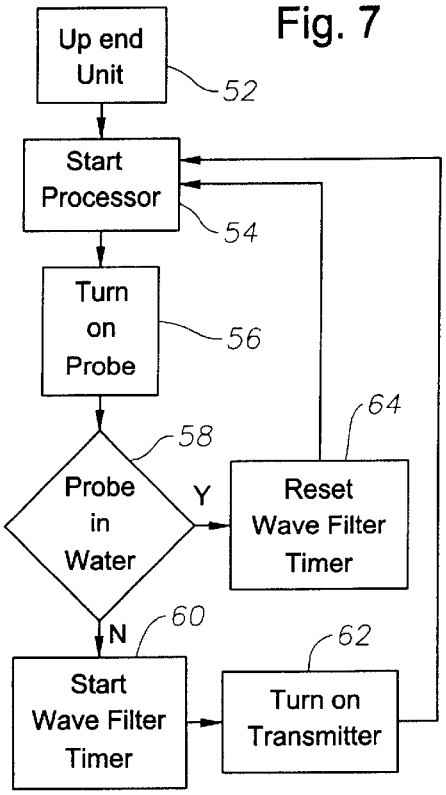
FIG. 7 is a flow chart illustrating the operation of the sensor and transmitter of FIG. 3.

The basic operation of the circuitry of FIG. 5 is illustrated in the block diagram of FIG. 6 and flow chart of FIG. 7. Power is turned on or sensor 28 reset in step 52 by closing switch 46 (FIG. 5), which occurs by inverting then returning sensor 28 to an upright position. As indicated in step 54, turning the power on starts processor 48, causing it to begin its duty and sleep cycles. Processor 48 applies voltage during the duty cycle to probes 30, as indicated by step 56.

As indicated by step 58, processor 48 makes a determination as to whether conductivity exists between probes 30 when voltage is supplied to the probes. If so, this indicates that probes 30 are in water, and processor 48 continues the duty and sleep cycles. If a lack of conductivity is detected between probes 30, step 60 indicates that a wave filter timer 61 is initiated. Wave filter timer 61 is an adjustable counter that is a part of processor 48 for avoiding spurious signals due to wave motion. Wave filter timer 61 determines how long the lack of conductivity must be present before sending a signal to the transmitter 50. For example, it may be set to count up to three minutes, and up until three minutes occurs, it will not allow a signal to be sent to transmitter 50. If during that three minute interval, processor 48 and probes 30 continuously detect a lack of conductivity during each duty cycle, then a signal is sent to transmitter 50 at the conclusion of the three minute interval, as indicated in step 62. Transmitter 50 will then send an RF signal to receiver 22 (FIG. 1) indicating that the water level is low. However, if at any time during the three minute interval of wave filter timer 61, probes 30 become immersed in water again, processor 48 will cause wave filter timer 61 to reset and stop as indicated by step 64. Wave filter timer 61 will not start counting again until processor 48 detects low water again.

Referring again to FIG. 2, a momentary RF signal 82 is sent by transmitter 50 (FIG. 5) of sensor assembly 21 when low water is detected for a selected time period. Receiver 22 receives signal 82 and transmits an open command by a wire 84 to solenoid valve 23. Solenoid valve 23 is connected in parallel with a manual valve 90, which in turn is connected to a water source 88. Water source 88 leads to the intake of pump 18 in this embodiment, although it could be a separate line from pump 18. Manual valve 90 will be normally closed, thus water will be supplied from source 88 only when solenoid valve 23 is open due to a signal received from receiver 22.

Figure 8:
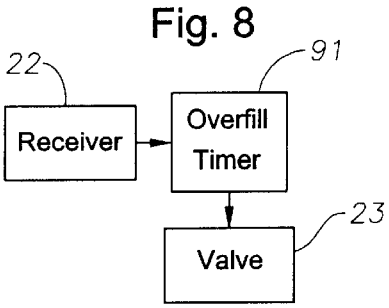
FIG. 8 is a block diagram of the major components of the receiver of FIG. 2.
Figure 9:
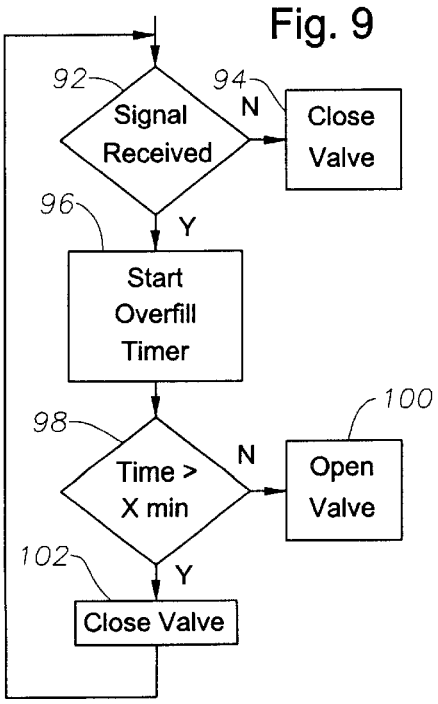
FIG. 9 is a flow chart illustrating the operation of the receiver for the water leveler of FIG. 2.

FIGS. 7 and 8 illustrate the operation of receiver 22, which is a conventional receiver except that it also incorporates an overfill timer or counter 91. As indicated in step 92, if a signal is not being received by receiver 22, solenoid valve 23 is closed, as indicated by step 94. If a signal is received by receiver 22, overfill counter 91 is started as indicated in step 96. Overfill timer 91, which is adjustable, will begin counting, as indicated by step 98 and open solenoid valve 23, as indicated by step 100 for a selected count or duration. When overfill counter 91 reaches its total count, step 102 indicates that the solenoid valve 23 will be closed.

Although the RF signal from transmitter 50 (FIG. 6) is a single momentary signal of selected duration, such a signal will be sent by transmitter 50 during each duty cycle of processor 48, as long as low water is indicated. Processor 48 will stop causing transmitter 50 to send signals only when it senses water with probes 30 (FIG. 6). Each time receiver 22 receives another signal from transmitter 50 it resets the overfill timer 91, indicated by step 96. Since these signals normally would be received each duty cycle of processor 48 until probes 30 become again immersed in water, overfill timer 91 will normally not reach the total count until probes 30 become immersed again. Once probes 30 become immersed, overfill timer 91 will then count up to the selected number without being reset, at which time it would provide a signal to close valve 23, as indicated in step 102. Overfill timer 91 thus assures that a selected overfill will occur after probes 30 are again immersed in water. For example, the overfill could be in a typical pool about ⅜ths of an inch as measured on probes 30 (FIG. 4).

In addition to overfill timer 91, there is also a fault detection timer that closes valve 23 to stop water from entering the pool if valve 23 has been open for a selected time duration, such as 30 minutes. This duration is set long enough to indicate that a fault is occurring and that overfill timer 91 should have closed valve 23 long before.

The system has significant advantages. The main power switch is fully sealed within the unit thus reducing the possibility of leakage or deterioration. This allows the circuitry to be reset or turned off without accessing an external switch. The user simply inverts the unit then returns it to its upright condition. The unit is readily removable from the throat of the skimmer by slightly unscrewing the cap relative to the base to shorten the overall length of the unit. There is no need to remove the transmitter and sensor from the container to turn it on and off.

The overfill timer associated with the sensor provides a means for avoiding spurious signals due to wave movement. The overfill timer of the receiver reduces the number of signals that would otherwise be transmitted by the transmitter. It does this by overfilling each time the water is low. Reducing the signals sent by the transmitter prolongs the life of the battery.

While the invention has been shown in only one of its forms, it should be apparent to those skilled in the art that it is not so limited but susceptible to various changes without departing from the scope of the invention.

We claim:

1. In an apparatus for controlling water level in a pool, having a water level sensor adapted to be immersed in the pool, a processor electrically connected with the sensor that detects low water in the pool, a wireless transmitter electrically connected with the processor for sending a radio frequency low water signal if the processor detects the low water, a waterproof housing containing the processor, the transmitter, and a battery for powering the processor and the transmitter, and a remote wireless receiver for receiving the signal from the transmitter and turning on a valve to add water to the pool, the improvement comprising:

a tilt switch connected between the battery and the processor for supplying power to the processor while in an upright (on) position, the tilt switch being enclosed and sealed within the housing and movable between the on and off position by tilting the housing.

2. The apparatus according to claim 1, wherein the tilt switch is in an off position when the housing is inverted from an operational position.

3. The apparatus according to claim 1, wherein the processor has a wave filter timer that turns on for a selected interval when the processor detects low water, and wherein the processor further has means for delaying the transmitter from sending the low water signal until the end of the selected interval and for causing the transmitter to send the low water signal at the end of the selected interval only if the processor continuously detects low water during the entire selected interval.

4. The apparatus according to claim 1, wherein a power input of the transmitter is connected to an output of the processor so that the transmitter is supplied with power only momentarily during each duty cycle of processor and only when the processor directs the transmitter to send the low water signal.

5. The apparatus according to claim 1, further comprising a low battery voltage detector in the housing, the low battery voltage detector being connected to the processor for informing the processor if low battery voltage is detected, the processor having means for delaying the transmitter from sending the low battery voltage indication until the processor detects low water and having means for encoding the low battery voltage indication into the low water signal being sent by the transmitter.

6. The apparatus according to claim 1, wherein the receiver has an overfill counter that turns on for a selected interval when the receiver receives one of the low water signals from the transmitter, the overfill counter causing the valve to remain on until the overfill counter reaches a selected count, and wherein the receiver has means for resetting the overfill counter prior to reaching the selected count each time that the receiver receives subsequent low water signals from the transmitter.

7. The apparatus according to claim 1, wherein the processor has a wave filter timer that turns on for a selected interval when the processor detects low water, and wherein the processor further has means for delaying the transmitter from sending the low water signal until the end of the selected interval and for causing the transmitter to send the signal at the end of the selected interval only if the processor continuously detects low water during the entire selected interval, the signal from the transmitter being a momentary low water signal; and wherein the receiver has an overfill counter that turns on for a selected interval when the receiver receives the momentary signal from the transmitter, the overfill counter causing the valve to remain on until the overfill counter reaches a selected count, and wherein the receiver has means for resetting the overfill counter each time that it receives subsequent momentary signals from the transmitter.

8. In an apparatus for controlling water level in a pool, having a water level sensor adapted to be immersed in the pool, a processor electrically connected with the sensor that detects low water in the pool, a wireless transmitter electrically connected with the processor for sending a digitally encoded radio frequency low water signal if the processor detects the low water, a waterproof housing containing the processor, the transmitter, and a battery for powering the processor and the transmitter, and a remote receiver for receiving the signal from the transmitter and turning on a valve to add water to the pool, the improvement comprising:

a wave filter timer within the processor that turns on for a selected interval when the processor detects low water;

wherein the processor further has means for delaying the transmitter from sending the low water signal until the end of the selected interval and for causing the transmitter to send the low water signal at the end of the selected interval only if the processor continuously detects low water during the entire selected interval; and wherein the low water signal sent by the transmitter is a momentary signal.

9. The apparatus according to claim 8, wherein a power input of the transmitter is connected to an output of the processor so that the transmitter is supplied with power only when the processor directs the transmitter to send the low water signal.

10. The apparatus according to claim 8, further comprising a low battery voltage detector in the housing, the low battery voltage detector being connected to the processor for informing the processor if low battery voltage is detected, the processor having means for delaying the transmitter from sending the low battery voltage indication until the processor detects low water and having means for encoding the low battery voltage indication into the digitally encoded low water signal being sent by the transmitter.

11. The apparatus according to claim 8, wherein the receiver has an overfill counter that turns on for a selected interval when the receiver receives one of the low water signals from the transmitter, the overfill counter causing the valve to remain on until the overfill counter reaches a selected count, and wherein the receiver has means for resetting the overfill counter prior to reaching the selected count each time that the receiver receives subsequent low water signals from the transmitter.

12. In an apparatus for controlling water level in a pool, having a water level sensor adapted to be immersed in the pool, a processor electrically connected with the sensor that detects low water in the pool, a transmitter electrically connected with the processor for sending a radio frequency low water signal if the processor detects the low water, a waterproof housing containing the processor, the transmitter, and a battery for powering the processor and the transmitter, and a remote receiver for receiving the signal from the transmitter and turning on a valve to add water to the pool, the improvement comprising:

an overfill counter in the receiver that turns on for a selected interval when the receiver receives one of the low water signals from the transmitter, the overfill counter causing the valve to remain on until the overfill counter reaches a selected count, and wherein the receiver has means for resetting the overfill counter prior to reaching the selected count each time that the receiver receives subsequent low water signals from the transmitter, the signals from the transmitter being momentary.

13. The apparatus according to claim 12, wherein a power input of the transmitter is connected to an output of the processor so that the transmitter is supplied with power only when the processor directs the transmitter to send the low water signal.

14. The apparatus according to claim 12, further comprising a low battery voltage detector in the housing, the low battery voltage detector being connected to the processor for informing the processor if low battery voltage is detected, the processor having means for encoding a low battery voltage indication into the signal being sent by transmitter that indicates low water.

15. A method for controlling water level in a pool, securing a water level sensor on the exterior of a waterproof housing;

mounting a processor, a transmitter, a battery, and a main power switch within the housing, the main power switch being a tilt switch that is sealed within the housing and inaccessible from an exterior of the housing;

placing the housing in a portion of the pool in an upright position, causing the switch to close and send power to the processor;

mounting a receiver remote from the housing, the receiver being electrically connected to a valve of a water supply source that leads to the pool;

sensing water level of the pool with the sensor, and if the processor detects low water in the pool, causing the transmitter to send a momentary radio frequency signal indicating low water level;

receiving the signal with the receiver and opening the valve to cause water from the water supply source to flow into the pool; and when it is desired to turn off the processor, tilting the housing to cause the switch to open.

16. The method according to claim 15, further comprising inverting the housing and leaving the housing in an inverted position to keep the power off.

17. The method according to claim 15, further comprising tilting the housing back to the upright position to reset the processor.

18. The method according to claim 15, further comprising:

upon detection of low water, delaying causing the transmitter to send the low water signal for a selected interval; and causing the transmitter to send the low water signal at the end of the selected interval only if the processor continuously detects low water during the entire selected interval.

19. The method according to claim 15, further comprising:

supplying power to the transmitter from an output of the processor only during each duty cycle of processor, and only when the processor directs the transmitter to send the low water signal.

20. The method according to claim 15, further comprising:

detecting voltage of the battery and informing the processor if low battery voltage is detected;

delaying sending the low battery voltage indication until the processor detects low water; and encoding a low battery voltage indication into the low water signal being sent by the transmitter.

21. The method according to claim 15, further comprising:

upon receipt of a low water signal from the transmitter by the receiver, turning on an overfill counter and causing the valve to remain on until the overfill counter reaches a selected count, and resetting the overfill counter prior to reaching the selected count each time that the receiver receives subsequent low water signals from the transmitter.

22. A method for controlling water level in a pool, securing a water level sensor on the exterior of a housing;

mounting a processor, a transmitter, and a battery in the housing;

placing the housing in a portion of the pool;

mounting a receiver remote from the housing, the receiver being electrically connected to a valve of a water supply source that leads to the pool;

sensing water level of the pool during periodic duty cycles with the sensor at a selected duty cycle rate and communicating the information sensed to the processor, and if the processor detects low water in the pool, starting a fill counter that counts to a selected number;

continuing to sense water level in the pool during periodic duty cycles at the selected duty cycle rate and if the processor receives information from the processor that the water level is no longer low, resetting the fill counter;

if the processor is detecting low water when the counter reaches the selected count, causing the transmitter to send a momentary radio frequency signal; and receiving the signal with the receiver and opening the valve to cause water from the water supply source to flow into the pool.

23. The method according to claim 22, further comprising:

supplying power to the transmitter from an output of the processor and only when the processor directs the transmitter to send the signal.

24. The method according to claim 22, further comprising:

detecting voltage of the battery and informing the processor if low battery voltage is detected; and encoding a low battery voltage indication into the signal being sent by transmitter that indicates low water.

25. The method according to claim 22, further comprising:

upon receipt of a signal from the transmitter by the receiver, turning on an overfill counter and causing the valve to remain on until the overfill counter reaches a selected count; and resetting the overfill counter prior to reaching the selected count each time that the receiver receives subsequent signals from the transmitter.

26. A method for controlling water level in a pool, securing a water level sensor on the exterior of a housing;

mounting a processor, a transmitter, and a battery in the housing;

placing the housing in a portion of the pool;

mounting a receiver remote from the housing, the receiver being electrically connected to a valve of a water supply source that leads to the pool;

sensing water level of the pool with the sensor and communicating the information sensed to the processor, and if the processor detects low water in the pool, causing the transmitter to send a momentary radio frequency signal;

receiving the signal by the receiver, opening the valve to cause water from the water supply source to flow into the pool;

on receipt of the signal by the receiver, turning on an overfill counter and causing the valve to remain on until the overfill counter reaches a selected count, and resetting the overfill counter prior to reaching the selected count each time that the receiver receives subsequent signals from the transmitter.

27. The method according to claim 26, further comprising:

supplying power to the transmitter from an output of the processor and only when the processor directs the transmitter to send the signal.

28. The method according to claim 26, further comprising:

detecting voltage of the battery and informing the processor if low battery voltage is detected; and encoding a low battery voltage indication into the signal being sent by transmitter that indicates low water.

29. A method for controlling water level in a pool, securing a water level sensor on the exterior of a housing;

mounting a processor, a transmitter, and a battery in the housing;

placing the housing in a portion of the pool;

mounting a receiver remote from the housing, the receiver being electrically connected to a valve of a water supply source that leads to the pool;

sensing water level of the pool with the sensor and communicating the information sensed to the processor, and if the processor detects low water in the pool, causing the transmitter to send a momentary radio frequency low water signal;

receiving the low water signal by the receiver, opening the valve to cause water from the water supply source to flow into the pool;

detecting voltage of the battery and informing the processor if low battery voltage is detected; and encoding a low battery voltage indication into the low water signal being sent by transmitter.

30. The method according to claim 29, further comprising supplying power to the transmitter from an output of the processor and only when the processor directs the transmitter to send the low water signal.

31. A method for controlling water level in a pool, securing a water level sensor on the exterior of a housing;

mounting a processor, a transmitter, and a battery in the housing;

placing the housing in a portion of the pool;

mounting a receiver remote from the housing, the receiver being electrically connected to a valve of a water supply source that leads to the pool;

sensing water level of the pool with the sensor and communicating the information sensed to the processor, and if the processor continuously detects low water in the pool, delaying for a predetermined interval before supplying power from the processor to the transmitter causing the transmitter to send a momentary low water radio frequency signal, the transmitter being supplied with power only when the processor directs the transmitter to send the low water signal; and receiving the low water signal by the receiver, opening the valve to cause water from the water supply source to flow into the pool.

* * * * *